US009320355B2

(12) United States Patent
Lee

(10) Patent No.: US 9,320,355 B2
(45) Date of Patent: Apr. 26, 2016

(54) BOTTLE RACK

(71) Applicant: Chao-Lung Lee, Taichung (TW)

(72) Inventor: Chao-Lung Lee, Taichung (TW)

( * ) Notice: Subject to any disclaimer, the term of this patent is extended or adjusted under 35 U.S.C. 154(b) by 0 days.

(21) Appl. No.: 14/488,312

(22) Filed: Sep. 17, 2014

(65) Prior Publication Data

US 2015/0076091 A1 Mar. 19, 2015

(30) Foreign Application Priority Data

Sep. 18, 2013 (TW) ..... 102217651 U

(51) Int. Cl.

| | |
|---|---|
| ***A47B 73/00*** | (2006.01) |
| ***A47B 43/00*** | (2006.01) |
| ***A47B 47/00*** | (2006.01) |
| ***A47B 57/00*** | (2006.01) |
| ***A47B 47/04*** | (2006.01) |
| ***A47B 87/02*** | (2006.01) |
| ***A47F 7/00*** | (2006.01) |
| ***A47F 7/28*** | (2006.01) |

(52) U.S. Cl.

CPC ..... *A47B 73/006* (2013.01); *A47B 47/0091* (2013.01); *A47B 47/047* (2013.01); *A47B 87/02* (2013.01); *A47F 7/0035* (2013.01); *A47F 7/0071* (2013.01); *A47F 7/283* (2013.01)

(58) Field of Classification Search

CPC .... A47B 73/006; A47B 73/00; A47B 73/008; A47B 47/0058; A47B 81/007; A47B 81/00; A47B 47/028; A47B 87/02; A47B 87/0207; A47B 47/0091; A47B 47/047; A47F 7/28; A47F 7/283; A47F 7/285; A47F 7/286; A47F 7/288; A47F 7/0021; A47F 7/0028; A47F 7/0035; A47G 23/02; A47G 23/0241; A47G 23/0266; A47G 23/0641; A47J 47/16

USPC ..... 211/74, 182, 188, 194, 75; D6/188, D6/114, 130; D7/71

See application file for complete search history.

(56) References Cited

U.S. PATENT DOCUMENTS

| | | | | | |
|---|---|---|---|---|---|
| 3,746,178 | A * | 7/1973 | Wagschal | A47B 73/006 | 211/194 |
| 4,093,076 | A * | 6/1978 | Newton | A47B 73/006 | 211/189 |
| 4,270,662 | A * | 6/1981 | Gonzalez | A47B 73/006 | 211/186 |
| 4,422,555 | A * | 12/1983 | Jacobs | A47B 73/006 | 211/189 |

(Continued)

FOREIGN PATENT DOCUMENTS

| | | |
|---|---|---|
| DE | 9201219 U1 | 7/1992 |
| GB | 1330786 A | 9/1973 |

*Primary Examiner* — Jennifer E Novosad

(74) *Attorney, Agent, or Firm* — CKC & Partners Co., Ltd.

(57) ABSTRACT

A bottle rack includes a plurality of first frame bodies, a plurality of second frame bodies and a plurality of connecting rods. Each of the first frame body includes a first assembling portion and a second assembling portion. The first assembling portion and the second assembling portion of the first frame body are embedded into the second assembling portion of another one of the first frame bodies and the first assembling portion of still another one of the first frame bodies respectively. Each of the second frame body includes a third assembling portion and a fourth assembling portion. The third assembling portion and the fourth assembling portion of the second frame body are embedded into the fourth assembling portion of another one of the second frame bodies and the third assembling portion of still another one of the second frame bodies respectively.

17 Claims, 10 Drawing Sheets

(56) References Cited

U.S. PATENT DOCUMENTS

D272,699 S * 2/1984 Godfrey ..... 211/74
4,550,539 A * 11/1985 Foster ..... A47B 73/006 428/118
4,969,568 A * 11/1990 Yoshida ..... B43M 99/008 211/186
5,947,305 A * 9/1999 Lin ..... A47B 73/006 211/74
5,971,167 A * 10/1999 Finbow ..... A47G 23/0208 206/426
7,604,133 B2 * 10/2009 Tsai ..... A47B 73/006 211/189
2003/0080073 A1 * 5/2003 Huang ..... A47B 73/00 211/40
2005/0011843 A1 * 1/2005 Dagan ..... A47F 7/283 211/74
2007/0017884 A1 * 1/2007 Yang ..... A47B 73/006 211/74
2007/0108144 A1 * 5/2007 Flick ..... C12H 1/22 211/74
2009/0289018 A1 * 11/2009 Yang ..... A47B 73/006 211/74
2011/0049068 A1 * 3/2011 Potter ..... A47B 73/00 211/69.1
2013/0008864 A1 * 1/2013 Davis ..... A47B 73/006 211/74
2013/0341295 A1 * 12/2013 Dixon ..... A47B 73/00 211/74
2015/0076091 A1 * 3/2015 Lee ..... A47B 73/006 211/85.4

* cited by examiner

BOTTLE RACK

RELATED APPLICATIONS

The application claims priority to Taiwan Application Serial Number 102217651, filed on Sep. 18, 2013, which is herein incorporated by reference.

BACKGROUND

1. Technical Field

The present disclosure relates to a rack, and more particularly relates to a bottle rack.

2. Description of Related Art

Wine-bottle rack is a kind of furniture that can be commonly seen in a house of people who is enthusiastic at wine tasting. Moreover, wine-bottle rack is also an indispensable equipment for wine-selling related industry. For meeting demands on larger storage capacity for wine-enthusiasts or wine-sellers, bottle rack having capacity expandable by combining the frame body has been reached to the commercial market.

However, a conventional combination-type bottle rack is commonly assembled by a number of storage units having accommodating space. Therefore, before assembling to a complete bottle rack, each of the storage units takes up space. Furthermore, conventional bottle rack is lacking of proper alignment to prevent the bottle from falling from the bottle rack accidently. Moreover, conventional bottle racks are not capable of putting the bottle therein in various angles.

SUMMARY

According to one aspect of the present disclosure, a bottle rack is provided. The bottle rack includes a plurality of first frame bodies, a plurality of second frame bodies and a plurality of connecting rods.

Each of the first frame bodies is a hexagon having equal interior angles, and each of the first frame bodies includes two first assembling units.

Each of the first assembling units includes a first assembling portion and a second assembling portion. The first assembling portion and the second assembling portion of each of the first assembling units are respectively disposed on two adjacent frames of the first frame body and are mirror inverted with each other. Each of the first assembling portions has a first hole, and each of the second assembling portions has a second hole.

The first assembling portion and the second assembling portion of the first assembling unit of the first frame body are embedded with the second assembling portion of one of the first assembling units of another one of the first frame bodies and the first assembling portion of one of the first assembling units of still another one of the first frame bodies respectively, and when the first assembling portion is embedded into the second assembling portion, the first hole of the first assembling portion is communicated with the second hole of the second assembling portion.

Each of the second frame bodies is a hexagon having equal interior angles, and each of the second frame bodies includes two second assembling units.

Each of the second assembling units includes a third assembling portion and a fourth assembling portion, the third assembling portion and the fourth assembling portion of each of the second assembling units is respectively disposed on two adjacent frames of the second frame body and are mirror inverted with each other, each of the third assembling portions has a third hole, and each of the fourth assembling portions has a fourth hole.

The third assembling portion of the second assembling unit of the second frame body and the fourth assembling portion of the second assembling unit of the second frame body are embedded with the fourth assembling portion of one of the second assembling units of another one of the second frame bodies and the third assembling portion of one of the second assembling units of still another one of the second frame bodies respectively, and when the third assembling portion is embedded into the fourth assembling portion, the third hole of the third assembling portion is communicated with the fourth hole of the fourth assembling portion.

The connecting rods are located between the first frame bodies and the second frame bodies for positioning each of the first frame bodies and each of the second frame bodies, and the connecting rods are positioned by the communicated first hole and second hole and the communicated third hole and fourth hole.

BRIEF DESCRIPTION OF THE DRAWINGS

The present disclosure can be more fully understood by reading the following detailed description of the embodiment, with reference made to the accompanying drawings as follows.

DETAILED DESCRIPTION

Figure 1A:
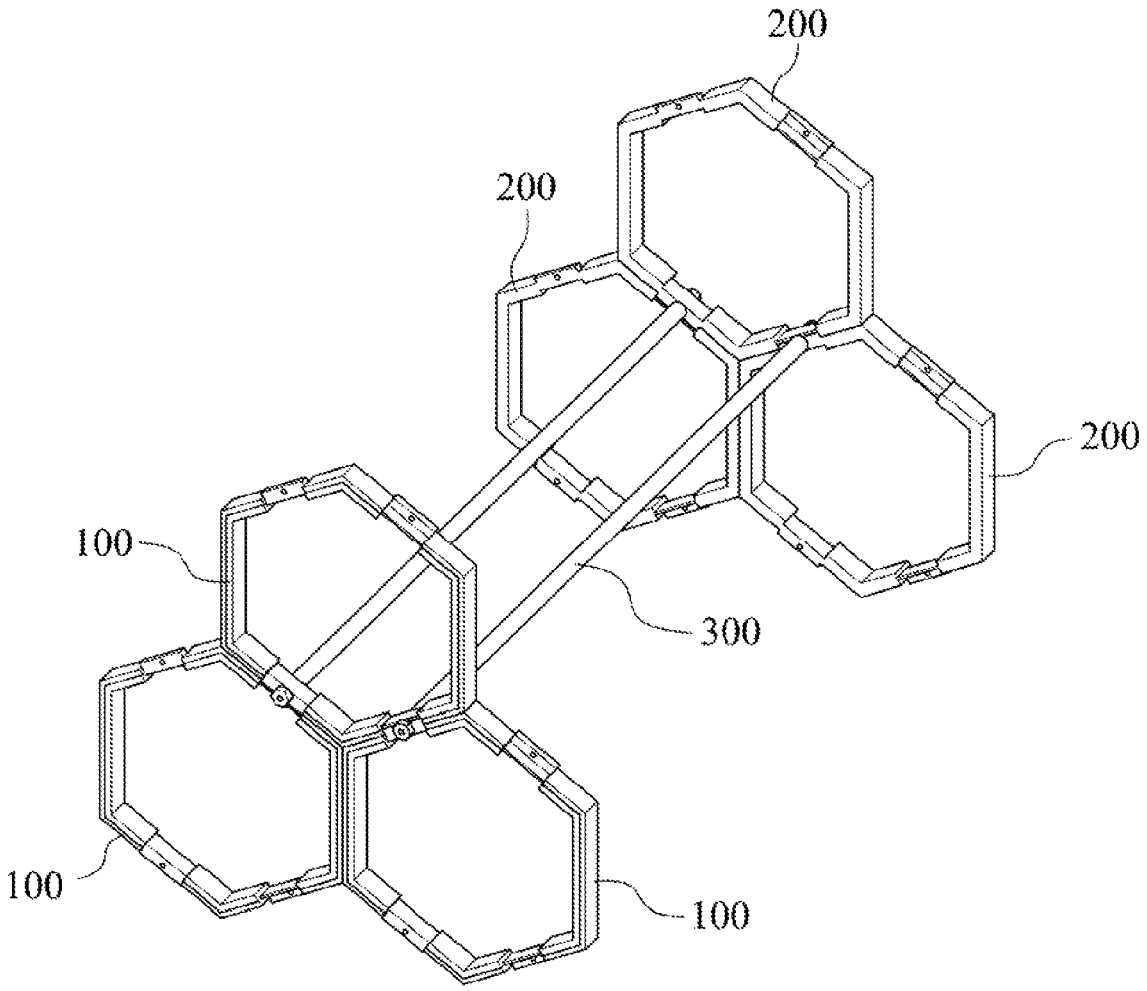
FIG. 1A is a three-dimensional view showing a bottle rack according to a first embodiment of the present disclosure.

Reference will now be made in detail to the present embodiments of the disclosure, examples of which are illustrated in the accompanying drawings. Wherever possible, the same reference numbers are used in the drawings and the description to refer to the same or like parts.

The present disclosure provides a bottle rack, having a simple structure and taking up less space, also being capable for mass production. In addition to easy assembling, the bottle rack of the present disclosure is capable for changing the way of placing and increasing security of the bottle in accordance with various situations.

FIG. 1A is a three-dimensional view showing a bottle rack according to a first embodiment of the present disclosure. The bottle rack includes three first frame bodies 100, three second frame bodies 200 and two connecting rods 300.

The first frame body 100 and the second frame body 200 are all regular hexagons and have the same structure.

Figure 1B:
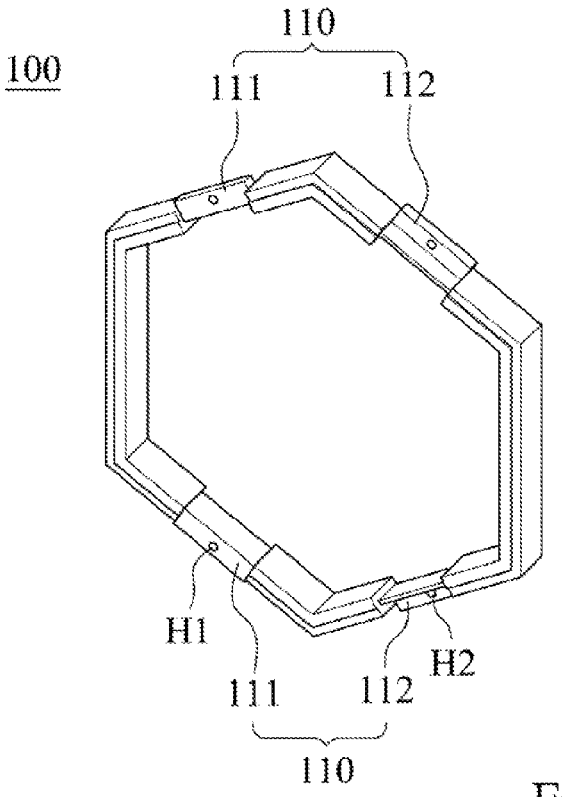
FIG. 1B is a three-dimensional view showing a first frame body of the bottle rack of FIG. 1A.
Figure 1C:
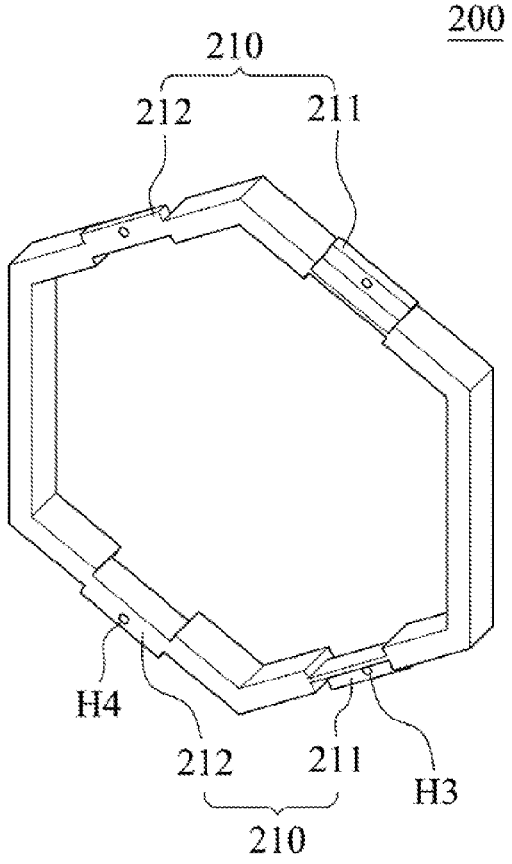
FIG. 1C is a three-dimensional view showing a second frame body of the bottle rack of FIG. 1A.

Please refer to FIG. 1B and FIG. 1C. FIG. 1B is a three-dimensional view showing a first frame body 100 of the bottle rack of FIG. 1A; and FIG. 1C is a three-dimensional view showing a second frame body 200 of the bottle rack of FIG. 1A.

The first frame body 100 includes two first assembling units 110; each of the first assembling units 110 includes a first assembling portion 111 and a second assembling portion 112. The first assembling portion 111 and the second assembling portion 112 are disposed on two adjacent frames of the first frame body 100. The first assembling units 110 of the first frame body 100 are mirror-inverted with each other. In detail, the first assembling units 110 of the first frame body 100 are mutually opposite, the two first assembling portions 111 are located at one side, and the two second assembling portions 112 are located at the other side. Furthermore, each of the first assembling portions 111 has a first hole H1, and each of the second assembling portions 112 has a second hole H2. The first assembling portions 111 and the second assembling portions 112 are mutually corresponded and can be embedded with each other.

Similarly, the second frame body 200 includes two second assembling units 210. Each of the second assembling units 210 includes a third assembling portion 211 and a fourth assembling portion 212. The third assembling portion 211 and the fourth assembling portion 212 are disposed on two adjacent frames of the second frame body 200. The second assembling units 210 of the second frame body 200 are mirror-inverted with each other. In detail, the second assembling units 210 of the second frame body 200 are mutually opposite, the two third assembling portions 211 are located at one side, and the two fourth assembling portions 212 are located at the other side. Furthermore, each of the third assembling portions 211 has to third hole H3, and each of the fourth assembling portions 212 has a fourth hole H4. The third assembling portions 211 and the fourth assembling portions 212 are mutually corresponded and can be embedded with each other.

Figure 1D:
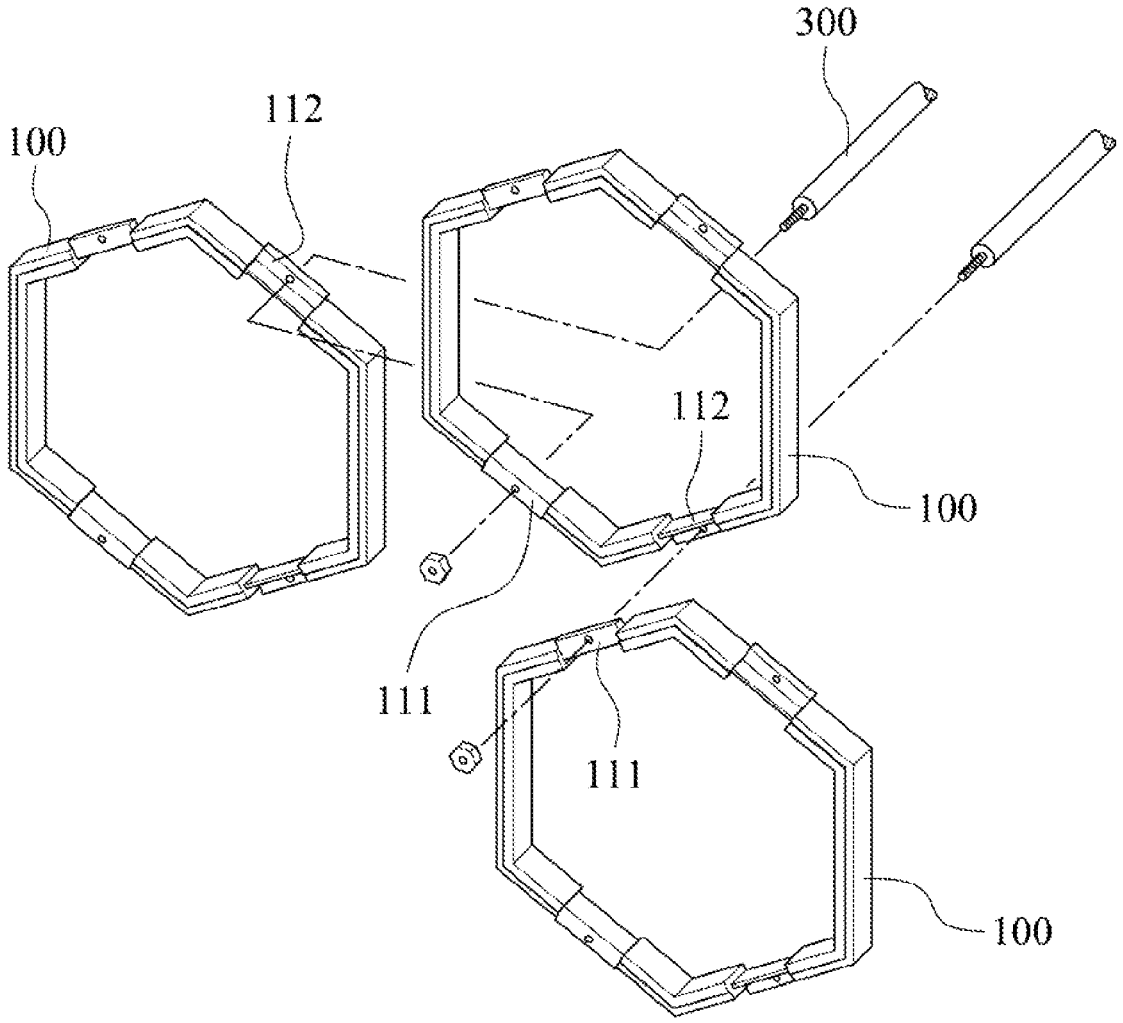
FIG. 1D is a partial exploded view showing the bottle rack of FIG. 1A.

Please refer to FIG. 1A, FIG. 1B and FIG. 1D. FIG. 1D is a partial exploded view showing the bottle rack of FIG. 1A.

Three first frame bodies 100 and three frame bodies 200 are constructed to form a front frame plane and a rear frame plane, respectively. In detail, the first assembling portion 111 of the first frame body 100 located at upper side is embedded into the second assembling portion 112 of the adjacent first frame body 100, and the second assembling portion 112 of the same first frame body 100 located at upper side is embedded into the first assembling portion 111 of the other adjacent first frame body 100. The first hole and the second hole H2 of the mutually embedded first assembling portion 111 and second assembling portion 112 are communicated. Similarly, the third assembling portion 211 of the second frame body 200 located at upper side is embedded into the fourth assembling portion 212 of the adjacent second frame body 200, and the fourth assembling portion 212 of the same second frame body 200 located at upper side is embedded into the third assembling portion 211 of the other adjacent second frame body 200. The third hole H3 and the fourth hole H4 of the mutually embedded third assembling portion 211 and fourth assembling portion 212 are communicated. Therefore, the front frame plane and the rear frame plane are formed.

Connecting rods 300 are used for connecting the front frame plane and the rear frame plane. In detail, the connecting rods 300 are positioned between each of the first frame bodies 100 of the front frame plane and each of the second frame bodies 200 of the rear frame plane by screw locking. The connecting rods 300 are through the communicated first hole H1 and second hole H2, and the communicated third hole H3 and fourth hole H4. Therefore, each of the first frame bodies 100 is corresponded to each of the second frame bodies 200, and the bottle rack is completely assembled. The way that connecting the front frame plane and the rear frame plane is not limited to screw locking, any conventional connecting ways can be used.

The aforementioned bottle rack has a simple structure, takes up less space, and is suitable for mass production. Moreover, in the aforementioned bottle rack, the ways that the two adjacent first frame bodies 100 embedded with the other first frame body 100 are converse; and the ways that the two adjacent second frame bodies 200 embedded with the other second frame body 200 are converse. Therefore, the stability of the bottle rack can be enhanced.

Figure 2A:
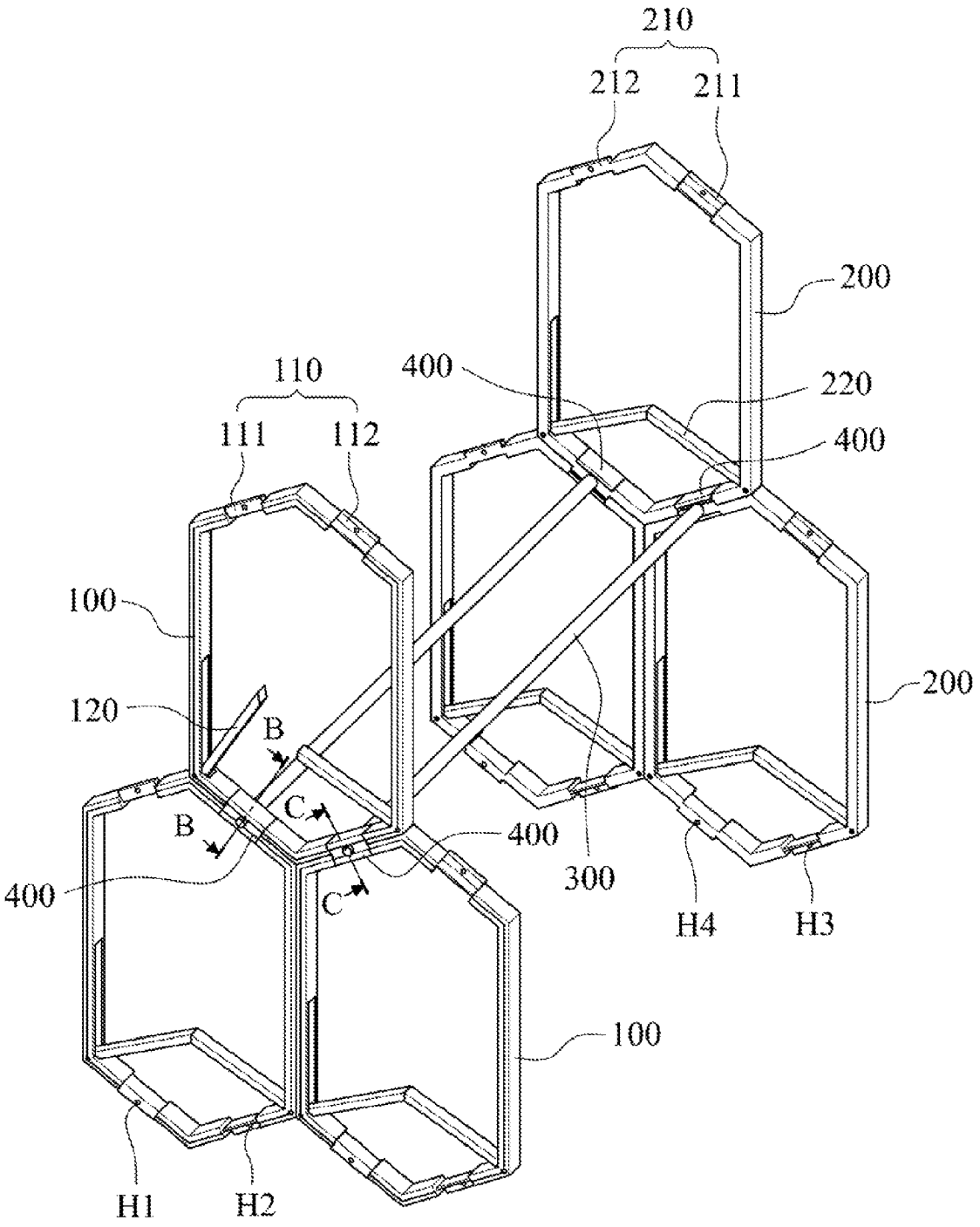
FIG. 2A is a three-dimensional view showing a bottle rack according to a second embodiment of the present disclosure.
Figure 2B:
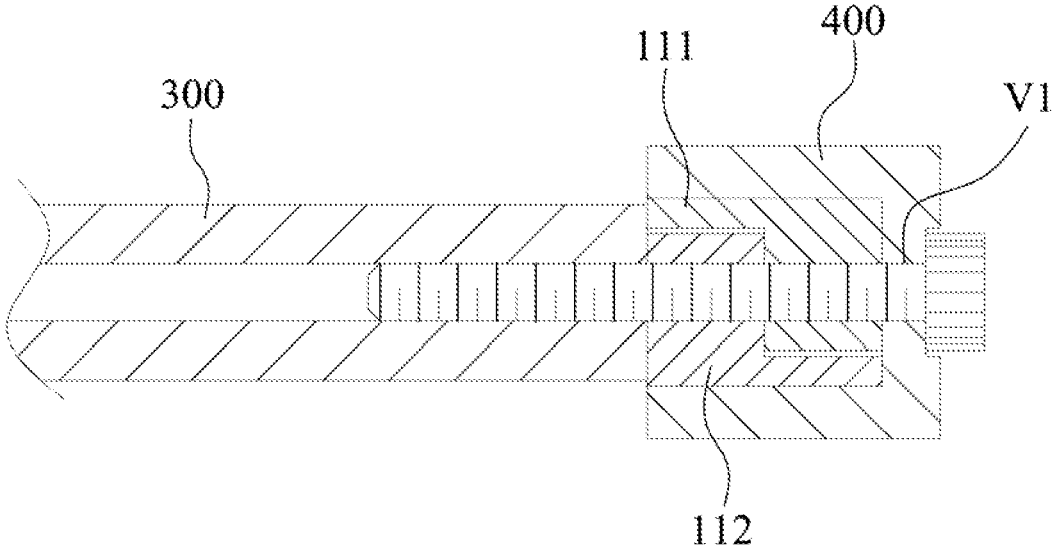
FIG. 2B is a section view showing the bottle rack of FIG. 2A taken alone line B-B.
Figure 2C:
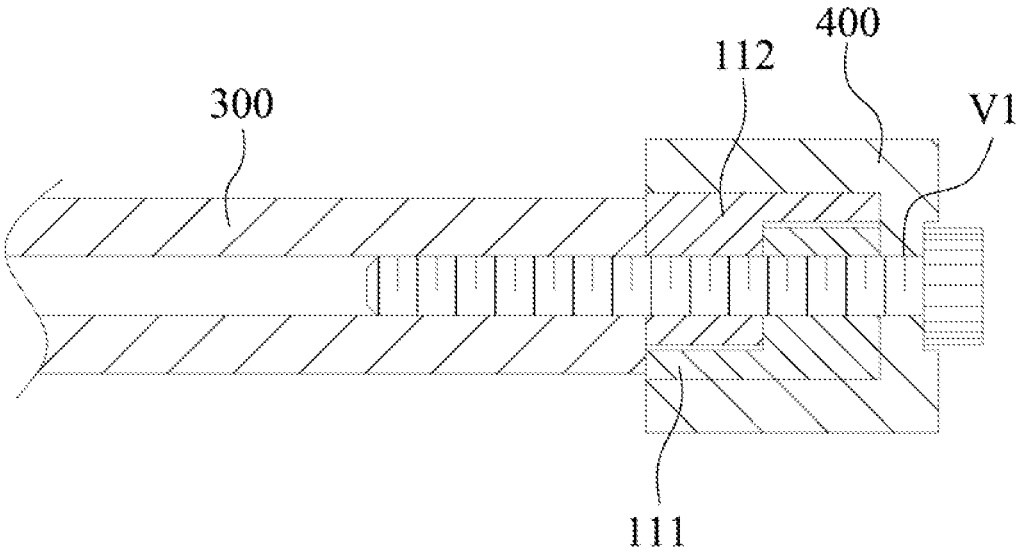
FIG. 2C is a section view showing the bottle rack of FIG. 2A taken alone line C-C.

FIG. 2A is a three-dimensional view showing a bottle rack according to a second embodiment of the present disclosure; FIG. 2B is a section view showing the bottle rack of FIG. 2A taken alone line B-B; and FIG. 2C is a section view showing the bottle rack of FIG. 2A taken alone line C-C.

The bottle rack includes three first frame bodies 100, three frame bodies 200, two connecting rods 300 and four positioning members 400. The first frame body 100 and the second frame body 200 are not regular hexagons, but the first frame body 100 and the second frame body 200 have equal interior angles, respectively. The first frame body 100 and the second frame body 200 also have similar structures.

Each of the positioning members 400 is aligned with the frames of the two adjacent first frame bodies 100, and each of the positioning members 400 clamps and positions the mutually embedded first assembling portion 111 and second assembling portion 112. The same, each of the positioning members 400 is aligned with the frames of the two adjacent second frame bodies 200, and each of the positioning members 400 clamps and positions the mutually embedded third assembling portion 211 and fourth assembling portion 212.

Each of the positioning members 400 has a through-hole V1. The through-hole V1 is communicated with the communicated first hole H1 and second hole H2, and the communicated third hole 143 and fourth hole 144.

The connecting rods 300 are positioned between the first frame bodies 100 forming the front frame plane and the second frame bodies 200 forming the rear frame plane by the communicated first hole H1, second hole H2 and through-hole V1, and the communicated third hole H3, fourth hole H4 and through-hole V1. Through the positioning member 400, the assembling stability of the bottle rack can be enhanced.

Furthermore, the first frame body 100 includes two first blocking members 120. The first blocking member 120 is pivotally embedded on the frames of the first frame body 100. In detail, the first blocking member 120 is pivotally embedded on the two frames without the first assembling portion 111 and the second assembling portion 112 of the first frame body 100. Therefore, the first blocking member 120 and the first assembling unit 110 are staggered.

Similarly, the second frame body 200 includes two second blocking members 220. The second blocking member 220 is pivotally embedded on the frames of the second frame body 200. In detail, the second blocking member 120 is pivotally embedded on the two frames without the third assembling portion 211 and the fourth assembling portion 212 of the second frame body 200. Therefore, the second blocking member 220 and the second assembling unit 210 are staggered.

Figure 2D:
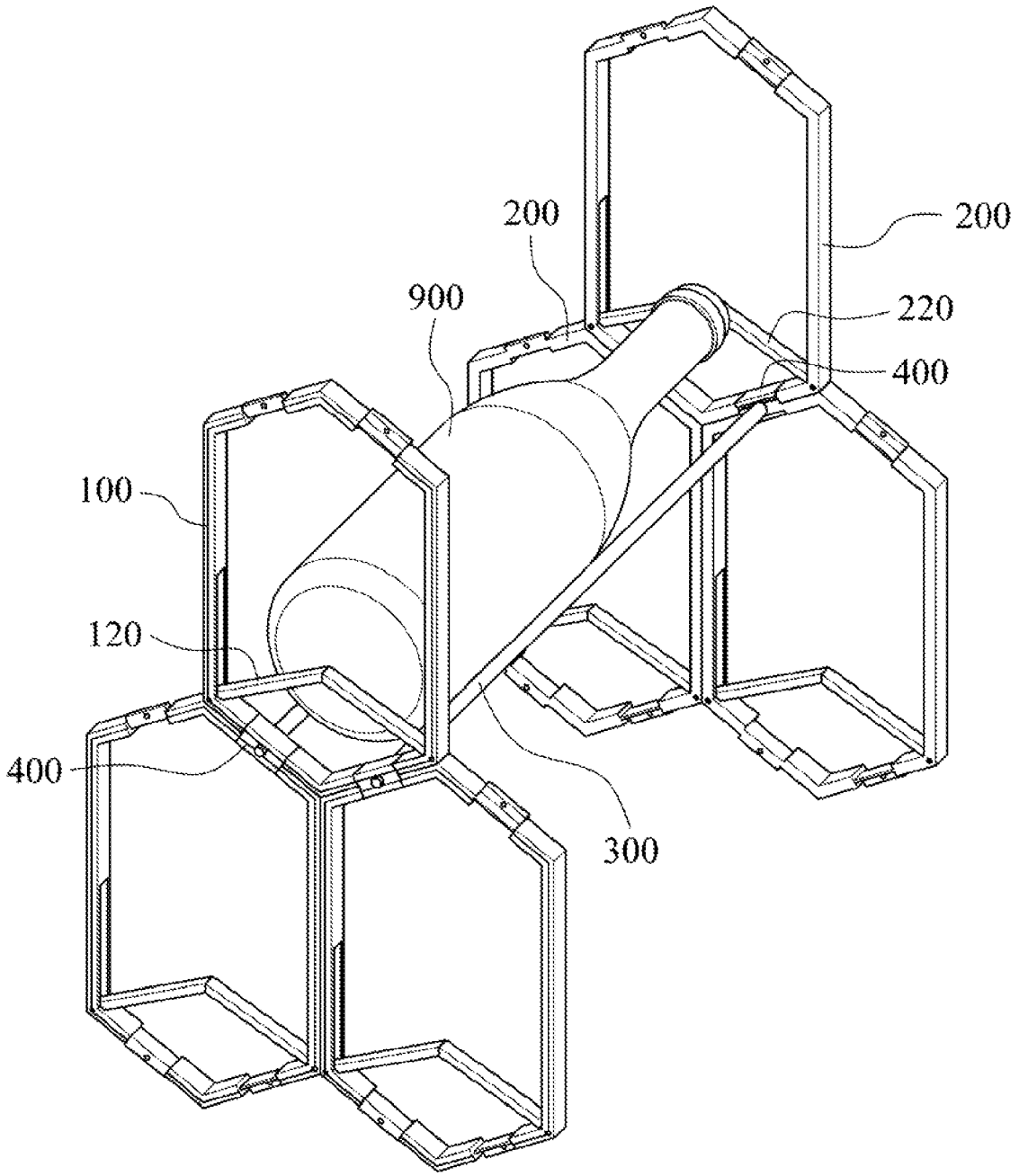
FIG. 2D is a diagram showing a using status of the bottle rack of FIG. 2A.

FIG. 2D is a diagram showing a using status of the bottle rack of FIG. 2A. In FIG. 2D, through the first blocking members 120 on the first frame body 100 and the second blocking members 220 on the second frame body 200, it is possible to prevent a bottle 900 from dropping and crashing from the bottle rack during a sudden occurrence, thus the security while putting the bottle 900 can be enhanced.

Figure 3:
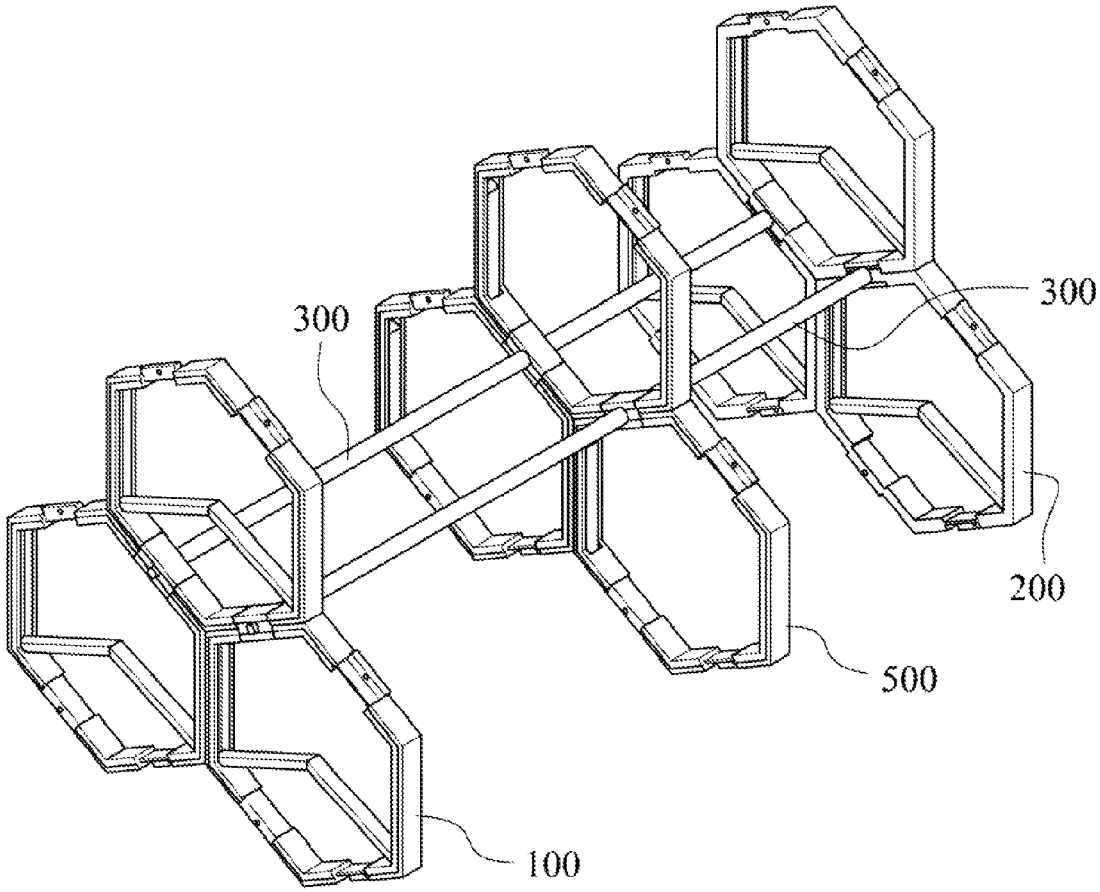
FIG. 3 is a three-dimensional view showing a bottle rack according to a third embodiment of the present disclosure.

FIG. 3 is a three-dimensional view showing a bottle rack according to a third embodiment of the present disclosure. In FIG. 3, the bottle rack further includes three third frame bodies 500. The structure of the third frame body 500 is the same as the first frame body 100 and the second frame body 200. The way that assembling each of the third frame bodies 500 is also the same as that of the first frame body 100 and the second frame body 200.

Similarly, connecting rod 300 can be used for positioning the third frame body 500 between the first frame body 100 and the second frame body 200 by the hole (not shown) of the third frame body 500. Thus each of the third frame bodies 500 is corresponded to each of the first frame bodies 100 and each of the second frame bodies 200. Therefore, through the connecting rod 300 and the third frame body 500, a length between the first frame body 100 and the second frame body 200 can be extended. Thus the structural strength and stability of the bottle rack can be enhanced, and the bottle rack can be used for puffing bottles having various lengths.

Figure 4:
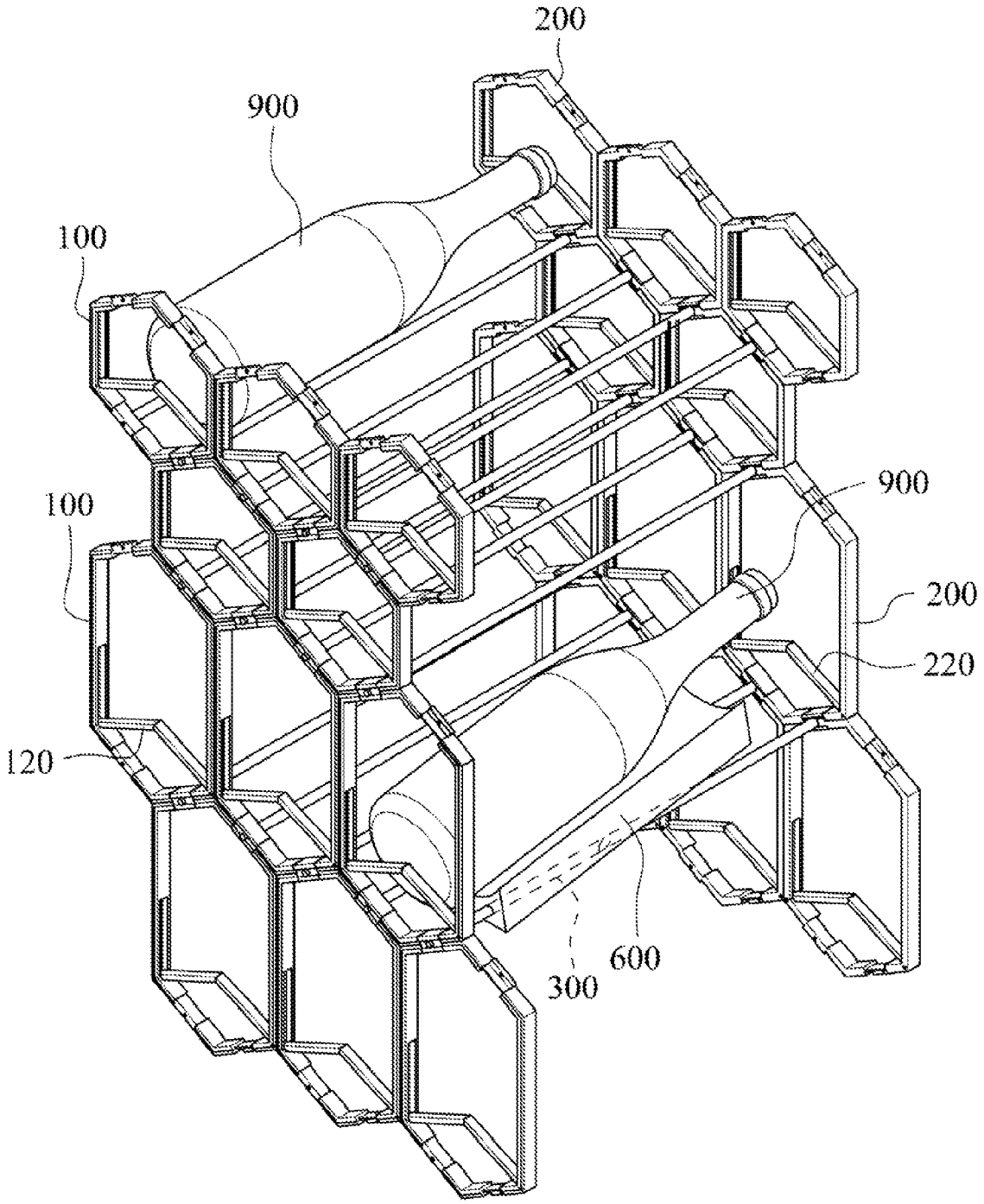
FIG. 4 is a diagram showing a using status of a bottle rack according to a fourth embodiment of the present disclosure.

FIG. 4 is a diagram showing a using status of a bottle rack according to a fourth embodiment of the present disclosure. In FIG. 4, the first frame body 100 and the second frame body 200 can be regular hexagons or irregular hexagons with equal interior angles. The bottle rack further includes a base 600. One end of the base 600 is supported by the connecting rod 300. In detail, one end of the base 600 has two corresponded oblique holes for inserting the connecting rods 300. Thus the base 600 can be obliquely put between the first frame body 100 and the second frame body 200. Therefore, the user can put bottle 900 to the bottle rack horizontally or obliquely to meet various demands. Moreover, the oblique angle can also be adjusted by the hole located in one end of the base 600. Furthermore, by the first blocking, member 120 of the first frame body 100 and the second blocking member 220 of the second frame body 200, the bottle 900 in the bottle rack can be prevented from failing into the ground while putting the bottle 900 obliquely.

Figure 5A:
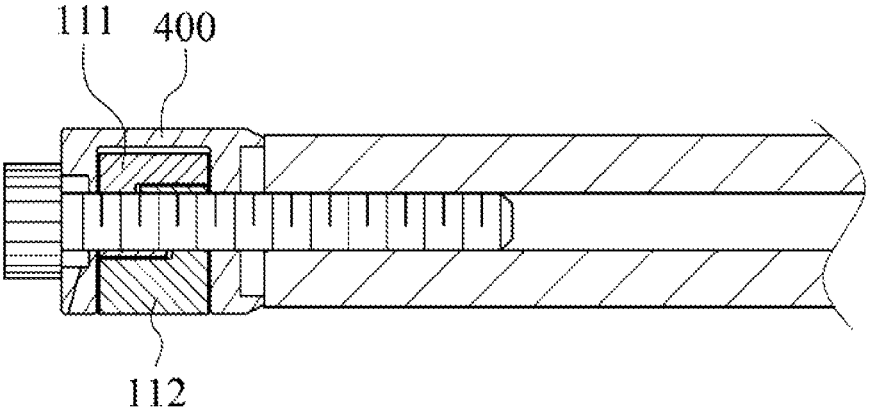
FIG. 5A is a partial section view showing a bottle rack according to a fifth embodiment of the present disclosure.
Figure 5B:
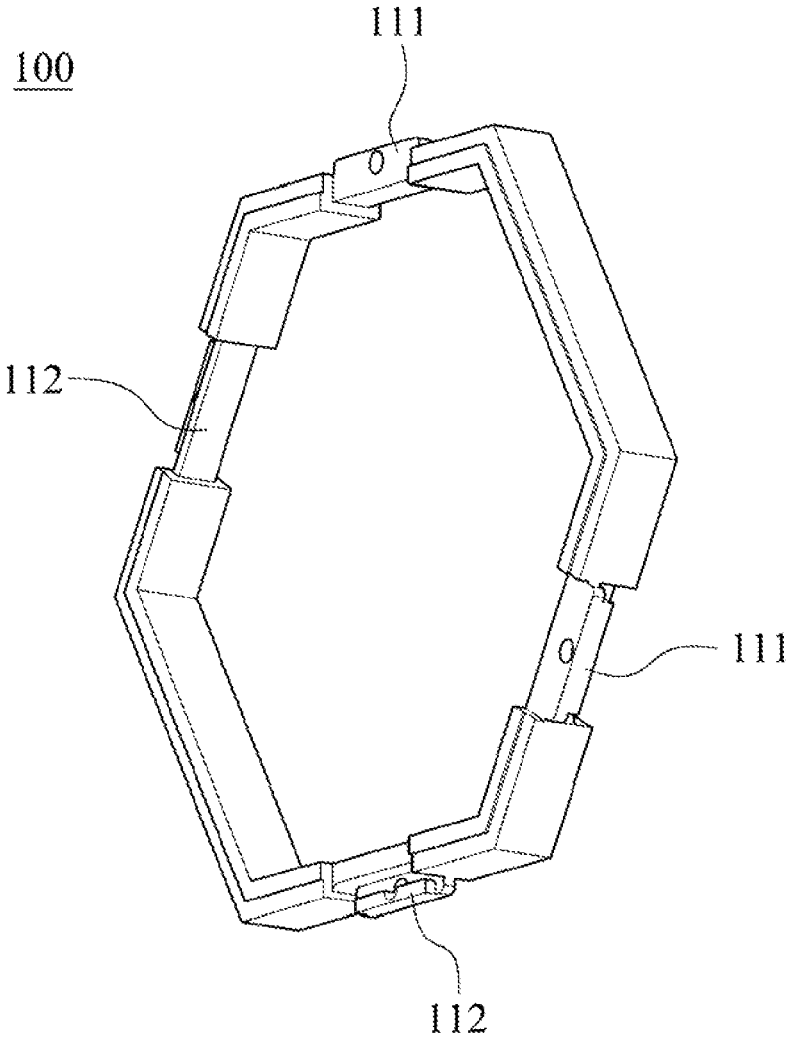
FIG. 5B is a three-dimensional view showing a first frame body of the bottle rack of FIG. 5A.

FIG. 5A is a partial section view showing a bottle rack according to a fifth embodiment of the present disclosure; and FIG. 5B is a three-dimensional view showing a first frame body 100 of the bottle rack of FIG. 5A.

In FIGS. 5A and 5B, the first assembling portion 111 and the second assembling portion 112 are substantially hook-shaped. Therefore, the first assembling portion 111 and the second assembling portion 112 can be tightly embedded, and thereby the stability and the security of the bottle rack are increased. Moreover, the positioning member 400 can clamp the embedded first assembling portion 111 and second assembling portion 112 from side direction.

Figure 6:
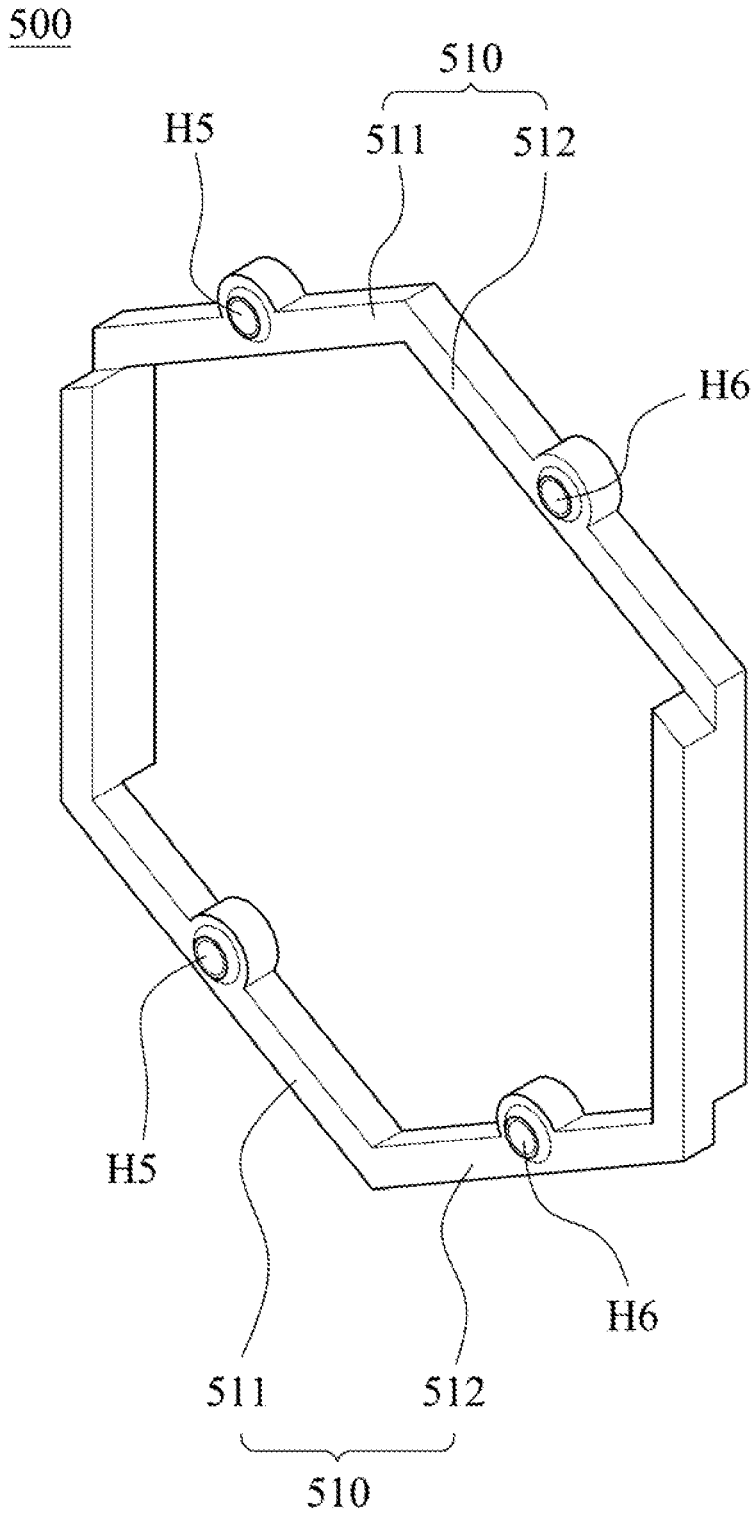
FIG. 6 is a three-dimensional view showing a third frame body of a bottle rack according to a sixth embodiment of the present disclosure.

FIG. 6 is a three-dimensional view showing a third frame body 500 of a bottle rack according to a sixth embodiment of the present disclosure. In FIG. 6, the thud frame body 500 is a hexagon with equal interior angles.

The third frame body 500 includes two third assembling units 510; each of the third assembling units 510 includes a fifth assembling, portion 511 and a sixth assembling portion 512. The fifth assembling portion 511 and the sixth assembling portion 512 are disposed on two adjacent frames of the third frame body 500. The third assembling, units 510 of the third frame body 500 are mirror-inverted with each other. In detail, the third assembling units 510 of the third frame body 500 are mutually opposite, the two fifth assembling portions 511 are located at the one side, and the two sixth assembling portions 512 are located at the other side. Furthermore, each of the fifth assembling portions 511 has a fifth hole H5, and each of the sixth assembling portions 512 has a sixth hole H6. The filth assembling portions 511 and the sixth assembling portions 512 are mutually corresponded and can be embedded with each other. The fifth hole H5 of the fifth assembling portion 511 and the sixth hole H6 of the sixth assembling portion 512 are mutually communicated. In the embodiment, the filth assembling portion 511 and the sixth assembling portion 512 of the third frame body 500 have the same structure.

Although the present disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. A bottle rack, comprising:

a plurality of first frame bodies, each of the first frame bodies being a hexagon having equal interior angles, and each of the first frame bodies comprising:

two first assembling units, each of the first assembling units comprising a first assembling portion and a second assembling portion, the first assembling portion and the second assembling portion of each of the first assembling units being respectively disposed on two adjacent frames of the first frame body, the two first assembling units being mirror inverted with each other, each of the first assembling portions having a first hole, and each of the second assembling portions having a second hole;

wherein the first assembling portion and the second assembling portion of the first assembling unit of the first frame body are embedded with the second assembling portion of one of the first assembling units of another one of the first frame bodies and the first assembling portion of one of the first assembling units of still another one of the first frame bodies respectively, and when the first assembling portion is embedded into the second assembling portion, the first hole of the first assembling portion is communicated with the second hole of the second assembling portion;

a plurality of second frame bodies, each of the second frame bodies being a hexagon having equal interior angles, and each of the second frame bodies comprising:

two second assembling units, each of the second assembling units comprising a third assembling portion and a fourth assembling portion, the third assembling portion and the fourth assembling portion of each of the second assembling units being respectively disposed on two adjacent frames of the second frame body and being mirror inverted with each other, each of the third assembling portions having a third hole, and each of the fourth assembling portions having a fourth hole;

wherein the third assembling portion and the fourth assembling portion of the second assembling unit of the second frame body are respectively embedded into the fourth assembling portion of one of the second assembling units of another one of the second frame bodies and the third assembling portion of one of the second assembling units of still another one of the second frame bodies, and when the third assembling portion is embedded into the fourth assembling portion, the third hole of the third assembling portion is communicated with the fourth hole of the fourth assembling portion; and a plurality of connecting rods located between the first frame bodies and the second frame bodies for positioning each of the first frame bodies and each of the second frame bodies, wherein the connecting rods are positioned by the communicated first hole and second hole, and the communicated third hole and fourth hole.

2. The bottle rack of claim 1, further comprising:

a plurality of positioning members for positioning the first assembling portion of the first assembling unit of the first frame body and the second assembling portion of one of the first assembling units of another one of the first frame bodies, or the third assembling portion of the second assembling unit of the second frame body and the fourth assembling portion of one of the second assembling units of another one of the second frame bodies.

3. The bottle rack of claim 2, wherein each of the positioning members is aligned with the two adjacent first frame bodies or the two adjacent second frame bodies.

4. The bottle rack of claim 3, wherein each of the positioning members has a through-hole, and the through-hole is communicated with the first hole and the second hole, or the through-hole is communicated with the third hole and the fourth hole.

5. The bottle rack of claim 4, wherein the connecting rods are positioned between the first frame bodies and the second frame bodies by the communicated first hole, second hole and through-hole, and the communicated third hole, fourth hole and through-hole.

6. The bottle rack of claim 5, wherein the connecting rods are positioned between the first frame bodies and the second frame bodies by screw locking.

7. The bottle rack of claim 6, wherein each of the first frame bodies further comprising:

at least one first blocking member pivotally embedded on the frames of the first frame body.

8. The bottle rack of claim 7, wherein each of the second frame bodies further comprising:

at least one second blocking member pivotally embedded on the frames of the second frame body.

9. The bottle rack of claim 8, wherein a number of the first blocking member or the second blocking member is two.

10. The bottle rack of claim 9, further comprising:

at least one base disposed between the first frame body and the second frame body, wherein one end of the base is supported by the connecting rods.

11. The bottle rack of claim 1, wherein each of the first frame bodies further comprising:

at least one first blocking member pivotally embedded on the frames of the first frame body.

12. The bottle rack of claim 11, wherein each of the second frame bodies further comprising:

at least one second blocking member pivotally embedded on the frames of the second frame body.

13. The bottle rack of claim 12, wherein a number of the first blocking member and the second blocking member is two.

14. The bottle rack of claim 1, further comprising:

at least one base disposed between the first frame body and the second frame body, wherein one end of the base is supported by the connecting rods.

15. The bottle rack of claim 1, wherein the connecting rods are positioned between the first frame bodies and the second frame bodies by screw locking.

16. The bottle rack of claim 1, wherein each of the first frame bodies and each of the second frame bodies are regular hexagons.

17. The bottle rack of claim 1, further comprising:

a plurality of third frame bodies, each of the third frame bodies being a hexagon having equal interior angles, the third frame bodies being disposed between the first frame bodies and the second frame bodies, and each of the third frame bodies comprising:

two third assembling units, each of the third assembling units comprising a fifth assembling portion and a sixth assembling portion, the fifth assembling portion and the sixth assembling portion of each of the third assembling units being disposed on two adjacent frames of the third frame body and being mirror inverted, each of the fifth assembling portions having a fifth hole, and each of the sixth assembling portions having a sixth hole;

wherein the fifth assembling portion and the sixth assembling portion of one of the third assembling units of the third frame body are respectively embedded with the sixth assembling portion of one of the third assembling units of another one of the third frame bodies and the fifth assembling portion of one of the third assembling units of still another one of the third frame bodies, and when the fifth assembling portion is embedded into the sixth assembling portion, the fifth hole of the fifth assembling portion is communicated with the sixth hole of the sixth assembling portion, wherein the connecting rods positioned between the first frame bodies and the second frame bodies position the third frame bodies between the first frame bodies and the second frame bodies by the communicated fifth hole and sixth hole.

* * * * *